US005282729A

United States Patent [19]

Swain

[11] Patent Number: 5,282,729

[45] Date of Patent: Feb. 1, 1994

[54] RADICAL ACTUATOR FOR A DE-ORBITING SCROLL IN A SCROLL TYPE FLUID HANDLING MACHINE

[75] Inventor: James C. Swain, Columbus, Ohio

[73] Assignee: General Motors Corporation, Detroit, Mich.

[21] Appl. No.: 70,603

[22] Filed: Jun. 2, 1993

[51] Int. Cl.[5] ..... F01C 1/02; F01C 1/063

[52] U.S. Cl. ..... 418/55.5; 418/57; 418/151

[58] Field of Search ..... 418/55.1, 55.3, 55.5, 418/57, 151

[56] References Cited

U.S. PATENT DOCUMENTS

| | | | |
|---|---|---|---|
| 4,314,796 | 2/1982 | Terauchi | 417/294 |
| 4,413,959 | 11/1983 | Butterworth | 418/14 |
| 4,431,327 | 2/1984 | Mazzagatti | 418/70 |
| 4,457,675 | 7/1984 | Inagaki et al. | 418/14 |
| 4,580,956 | 4/1986 | Takahashi et al. | 418/55 |
| 4,585,402 | 4/1986 | Morishita et al. | 418/55 |
| 4,585,403 | 4/1986 | Inaba et al. | 418/55 |
| 4,764,096 | 8/1988 | Sawai et al. | 418/55 |
| 4,856,973 | 8/1989 | Hirano et al. | 418/55 |
| 5,199,862 | 4/1993 | Kondo et al. | 418/55.5 |

*Primary Examiner*—Richard A. Bertsch
*Assistant Examiner*—Charles G. Freay
*Attorney, Agent, or Firm*—Patrick M. Griffin

[57] ABSTRACT

A scroll compressor (10) with a fixed scroll (18) and orbital scroll (20) has an axial thrust and anti-rotation assembly (22), a drive assembly (24), a balance assembly (26) and a control system (28). The drive assembly (24) includes a crankshaft (116) and a bushing assembly (108). The bushing assembly includes a bushing body (146) with a slot (154) journaled on the orbital scroll and a drive lug (150) positioned in the slot and non-rotatably secured to the crankshaft (116). Springs (156) bias the bushing body toward a position in which the axis of the bushing body (178) coincides with the axis (176) of the crankshaft and the crankshaft can rotate without moving the orbital scroll. The bushing body (146) can be moved by compressed fluid to a position in which the springs (156) are compressed, the scroll wraps (34 and 56) are in sealing contact and the drive assembly will drive the orbital scroll in a circular orbit with a radius $R_0$. The balance assembly includes two weight assemblies (184 and 186) with four weights (192, 196, 210 and 214) that are rotated about the axis of a cylindrical extension (182) in response to movement of the drive lug (150) relative to the bushing body (146) between a position in which the orbital scroll (20) is balanced and a position in which the weights balance themselves when the crankshaft (116) rotates without driving the orbital scroll. The control system (28) includes a trigger compressor (242) and a solenoid valve (246) which directs compressed fluid to the sump (88) when the solenoid valve is open and to the chamber (162) in the bushing assembly (108) when the solenoid valve is closed.

2 Claims, 6 Drawing Sheets

RADICAL ACTUATOR FOR A DE-ORBITING SCROLL IN A SCROLL TYPE FLUID HANDLING MACHINE

TECHNICAL FIELD

This invention is in a scroll type fluid material handling machine and more specifically in a clutchless scroll type fluid material handling machine with a fixed scroll and an orbital scroll which compress, pump, expand or meter fluid material.

BACKGROUND OF THE INVENTION

Scroll type fluid material handling machines are commonly used to compress, pump, expand or meter fluids. These machines have a pair of scrolls with end plates and spiral wraps that cooperate to form a pair of fluid pockets. The fluid pockets move either toward the center of the end plates or toward the radially outer edge of the end plates depending upon the direction of orbital movement of one scroll relative to the other scroll. The relative orbital movement of one scroll relative to the other scroll can be obtained by rotating both scrolls about axes that are offset from each other or by holding one scroll in a fixed position and driving the other scroll in an orbit relative to the fixed scroll.

Scroll type fluid displacement machines which form fluid pockets and move the pockets toward the center of the scrolls are commonly used to compress fluid. As the fluid pockets move toward the center of the scrolls, the pockets decrease in volume thereby compressing the fluid they contain. The fluid pockets deliver the compressed fluid they contain to a discharge aperture at an elevated pressure near the center of the end plates. Such compressors are useful in various machines including refrigeration systems.

Scroll type compressors can be driven by a dedicated power source which drives only the compressor. When they are driven by a dedicated power source, the power source can be turned off when the compressor is not needed. Other scroll type compressors are driven by power sources that drive driven equipment other than the compressor. An example of such a compressor would be an air conditioning compressor for a vehicle with an electric motor or an internal combustion engine which provides power to propel the vehicle, to steer the vehicle, to brake the vehicle, and to operate other accessories. When a scroll compressor is driven by a power source that provides power for other functions, it is desirable and generally necessary to provide a separate clutch that allows the scroll type compressor to be disconnected when it is not needed. Substantial energy can be saved by disconnecting a compressor when the compressor is not needed.

Clutches for scroll type compressors can take many forms. The most common type clutch used to drive compressors on automotive vehicles are electromagnetic clutches. Electromagnetic clutches are relatively small, compact, reliable and efficient compared to some other clutches. However, an electromagnetic clutch attached to a scroll compressor substantially increases the size and weight of a compressor and drive clutch combination. An electromagnetic clutch is likely to be larger in diameter than a scroll type compressor that it drives. The electromagnetic clutch also increases the length of a clutch and compressor combination. In addition to being physically large, electromagnetic clutches have substantial weight. A lightweight scroll type compressor could weigh less than the electromagnetic clutch which drives it.

SUMMARY OF THE INVENTION

An object of the invention is to provide a clutchless scroll type fluid material handling machine.

Another object of the invention is to provide a clutchless scroll type fluid material handling machine which is reliable, light weight and small compared to a similar capacity machines with clutches.

A further object of the invention is to provide a scroll type fluid material handling machine with a fixed scroll, an orbital scroll and an orbital scroll drive with orbital drive radius that can be reduced to zero to stop orbital movement of the orbital scroll.

A still further object of the invention is to provide an orbiting and de-orbiting actuator for a clutchless scroll machine which is compact, reliable, and does not require liquid oil from a sump for actuation.

The orbital scroll of the fluid material handling machine is driven in an orbital path by a crankshaft and a bushing assembly. The bushing assembly includes a bushing body that is rotatably journaled on the end plate of the orbital scroll. The bushing assembly also includes a drive lug that is non-rotatably connected to the crankshaft and is confined in a slot in the bushing body. When the bushing body is moved relative to the drive lug to position the drive lug in one end of the slot in the bushing body, the throw of the crankshaft and bushing assembly is zero and the orbital scroll is essentially stationary when the crankshaft is rotating. When the bushing body is moved relative to the driving lug to position the drive lug near the other end of the slot in the bushing body, the throw of the crankshaft and bushing assembly is substantially equal to the design orbit radius of the orbital scroll. The actual throw of the crankshaft and bushing assembly is allowed to vary to accommodate variations in the shape of the scroll wraps and to insure that the flanks of the scroll wraps are driven toward contact to form sealed fluid contact. A control system is provided to move the bushing body relative to the drive lug to a position in which the orbital scroll is stationary or to a position in which the wrap flanks form sealed fluid pockets and the orbital scroll is driven in an orbital path.

The foregoing and other objects, features and advantages of the present invention will become apparent in the light of the following detailed description of an exemplary embodiment thereof, as illustrated in the accompanying drawing.

DESCRIPTION OF THE PREFERRED EMBODIMENT

The invention will be described as part of a scroll type compressor for convenience. The invention can be employed in other fluid displacement machines such as vacuum pumps, fluid pumps, fluid expanders and fluid metering machines as well as compressors as would be obvious to one with some knowledge concerning scroll type machines.

Figure 10:
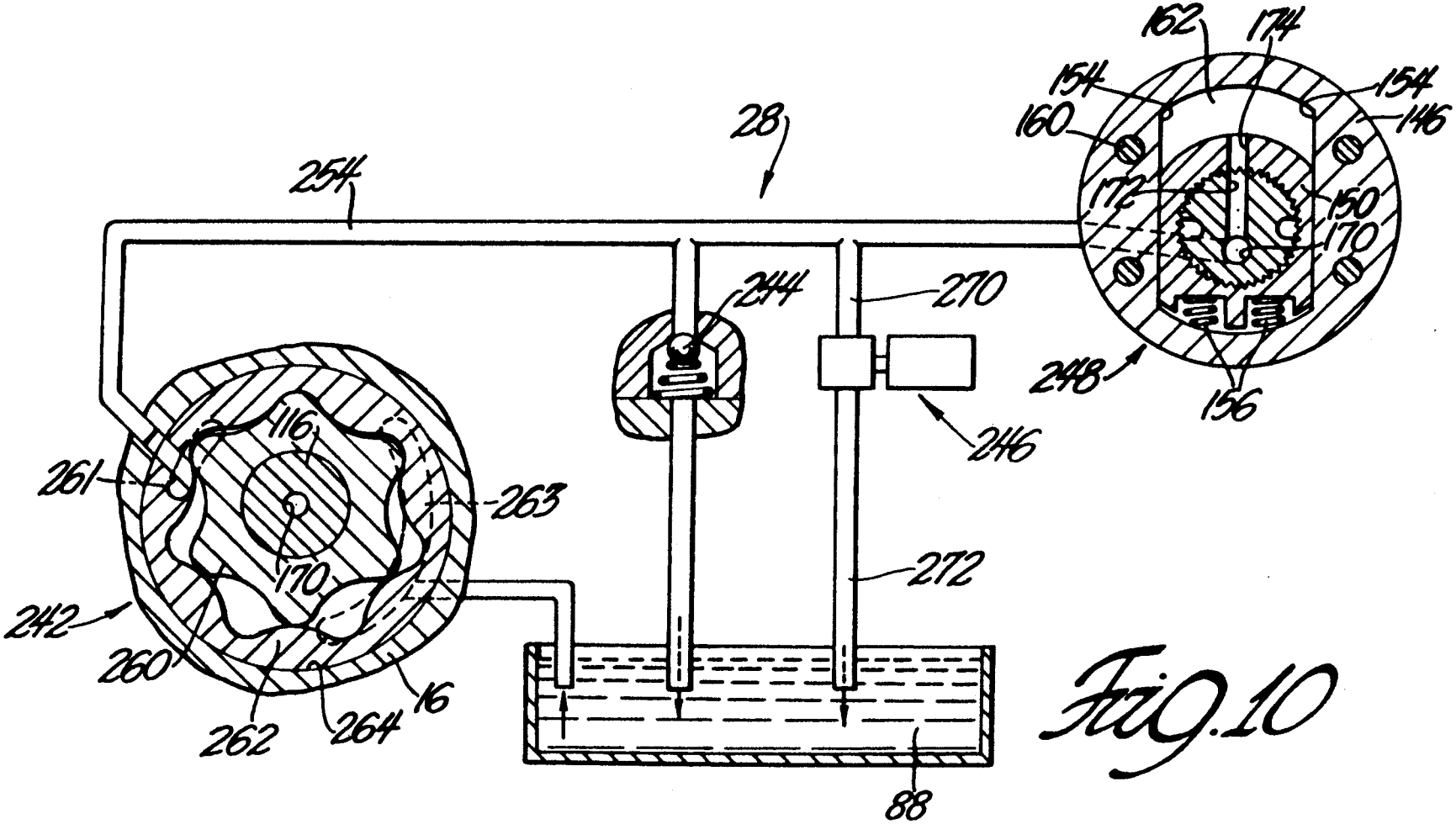
FIG. 10 is a schematic view of the control system for engaging and disengaging the scroll drive.

The scroll compressor 10 includes a housing 12 with a rear section 14 and a front section 16. The rear section 14 of the housing 12 has an integral fixed scroll 18. An orbital scroll 20 is orbitally mounted in the housing 12 to cooperate with the fixed scroll 18. An axial thrust and anti-rotation assembly 22 is mounted between the front section 16 of the housing 12 and the orbital scroll 20. A drive assembly 24 is mounted in the front section 16 of the housing 12 and is connected to the orbital scroll 20 to drive the orbital scroll 20 in a generally circular orbit. A balance assembly 26 balances orbital movement of the orbital scroll 20 when the drive assembly 24 is engaged. The balance assembly 26 balances the balance assembly itself when the drive assembly 24 is disengaged. A control system 28, shown in FIG. 10, is provided to engage the drive assembly 24 to drive the orbital scroll 20.

Figure 1:
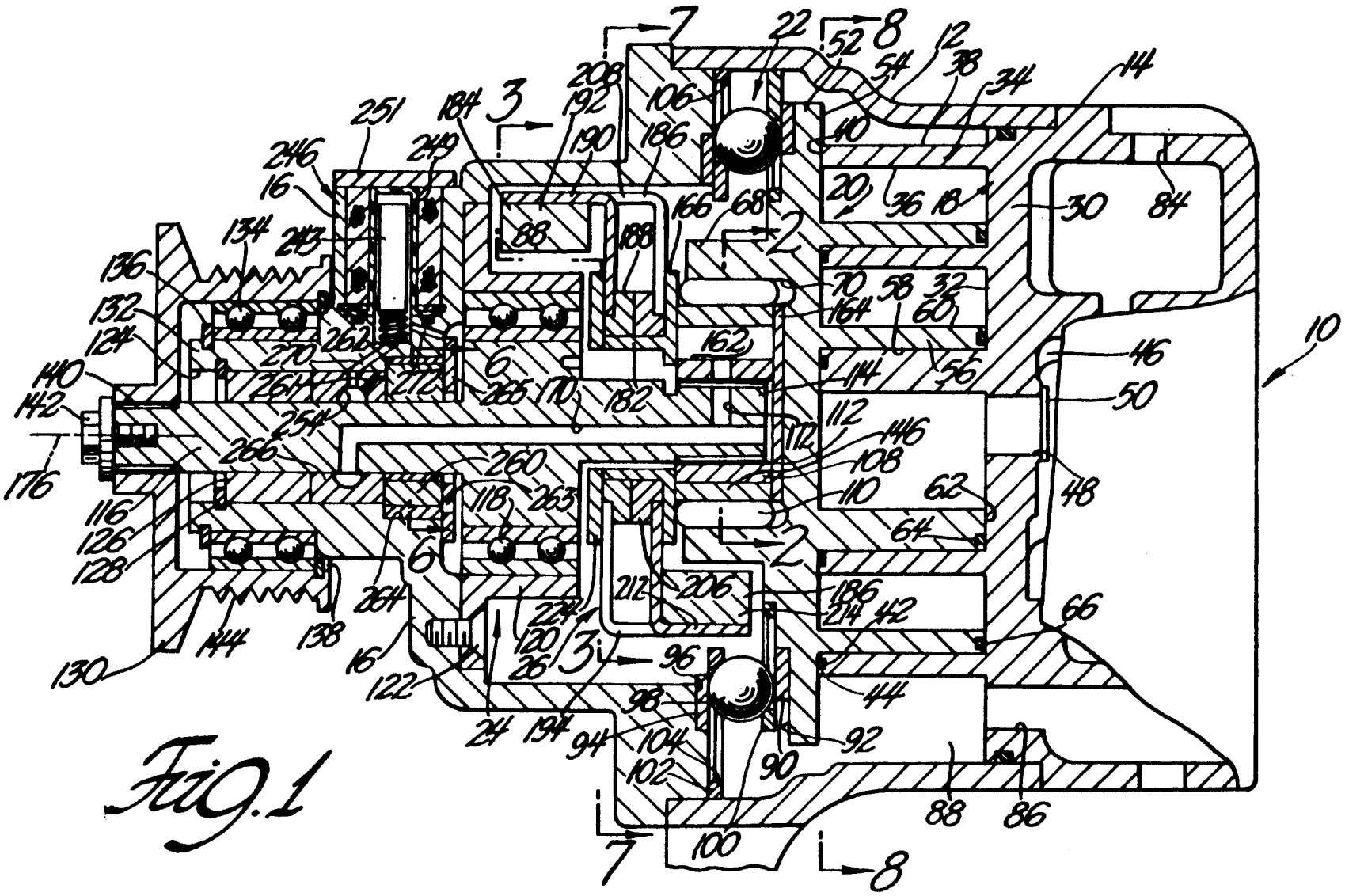
FIG. 1 is a vertical cross section through a clutchless scroll compressor.

The fixed scroll 18 includes an end plate 30, with a flat surface 32 and an involute wrap 34. The involute wrap 34 has an inside flank 36, an outside flank 38 and an axial tip 40. The axial tip 40 has a tip seal groove 42. A tip seal 44 is positioned in the tip seal groove 42. The end plate 30 forms the front wall of an enclosed exhaust chamber 46. An exhaust aperture 48 provides a passage through the end plate 30 for the passage of fluid from the scrolls 18 and 20 to the exhaust chamber 46. A reed valve 50 is mounted inside the exhaust chamber 46 to allow free passage of fluid from the scrolls to the exhaust chamber 46 and to prevent the flow of fluid from the exhaust chamber 46 to the scrolls 18 and 20. As shown in FIG. 1, the reed valve 50 is closed. The reed valve 50 is forced open by fluid in the scrolls 18 and 20 when the fluid is at a pressure that exceeds the pressure of fluid in the exhaust chamber 46.

The orbital scroll 20 includes an end plate 52 with a flat surface 54 and an involute wrap 56. The involute wrap 56 has an inside flank 58, an outside flank 60 and an axial tip 62. The axial tip 62 has a tip seal groove 64. A tip seal 66 is positioned in the tip seal groove 64. A boss 68 with a circular bore 70 is integral with the front side of the end plate 52.

The orbital scroll 20 may be anodized aluminum. The fixed scroll 18 may be aluminum that has not been anodized. A steel wear plate can be placed against the flat surface 32 of the end plate 30 if desired, to prevent wear of the flat surface 32 due to the tip seal 66 and the axial tip 62 sliding in a generally circular orbit on the flat surface. A wear plate has not been shown in the drawing. The use of wear plates is common but not mandatory. A wear plate could also be mounted against the flat surface 54 on the end plate 52. Wear plates are not, however, generally required on anodized surfaces.

Figure 8:
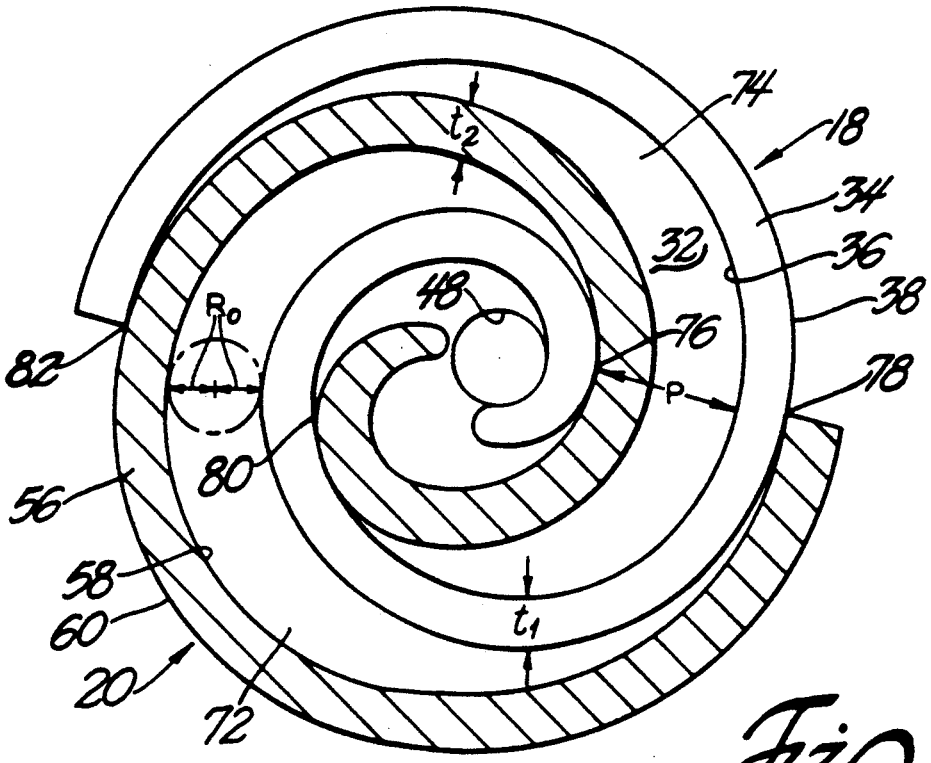
FIG. 8 is a cross sectional view of the scrolls taken along line 8—8 in FIG. 1.

The fixed scroll 18 and the orbital scroll 20 cooperate to form a pair of fluid pockets 72 and 74, as shown in FIG. 8. The fluid pocket 72 is bounded by line contacts between the inside flank 58 of wrap 56 and the outside flank 38 of the wrap 34 at 76 and 78, by contact between the tip seal 44 and the flat surface 54 and by contact between the tip seal 66 and the flat surface 32. The fluid pocket 74 is bounded by the line contacts between the inside flank 36 of the wrap 34 and the outside flank 60 of the wrap 56 at 80 and 82, by contact between the tip seal 44 and the flat surface 54 and by contact between the tip seal 66 and the flat surface 32. During operation of the scroll compressor 10, the orbital scroll 20 moves clockwise in a circular orbit with a radius $R_0$, as shown in FIG. 8. As the orbital scroll 20 moves in a circular orbit relative to the fixed scroll 18, the line contacts at 76, 78, 80 and 82 move along the surfaces of the flanks 36, 38, 58 and 60 toward the center of the scrolls. Movement of the line contacts at 76, 78, 80 and 82 results in movement of the fluid pockets 72 and 74 toward the center of the scrolls 18 and 20. As the fluid pockets 72 and 74 move toward the center of the scrolls 18 and 20, they decrease in volume and the fluid in the pockets is compressed. When the fluid pockets 72 and 74 reach the center portion of the scrolls 18 and 20, they communicate with the exhaust aperture 48 and the compressed fluid in the fluid pockets is forced through the exhaust aperture and into the exhaust chamber 46. Compressed fluid in the exhaust chamber 46 flows from the exhaust chamber and out of the housing 12 through an outlet port 84.

Movement of the contact lines at 78 and 82 toward the center of the scrolls 18 and 20 from the locations shown in FIG. 8 starts the formation of new fluid pockets. These new fluid pockets suck fluid through a fluid inlet port 86 and out of an inlet chamber 88.

The fixed scroll 18 and the orbital scroll 20 have the same pitch P. The radius $R_0$ of the orbital scroll orbit where the thickness of the wrap 34 of the fixed scroll 18 is $t_1$ and the thickness of the wrap 56 of the orbital scroll 20 is $t_2$ is determined by the following equation:

$$R_0=(P-t_1-t_2)\tfrac{1}{2}$$

The pitch P for the scrolls 18 and 20 depends upon the diameter of the generating circle chosen for the involutes.

The axial thrust and anti-rotation assembly 22 includes a flat ring race 90 attached to a flat surface 92 on the front side of the end plate 52 of the orbital scroll 20 and a flat ring race 94 attached to a flat surface 96 on the inside of the front section 16 of the housing 12. A plurality of thrust balls 98 are positioned between the flat ring race 90 and the flat ring race 94. The number of thrust balls 98 employed can vary. However, sixteen thrust balls 98 have been found to work well in some compressor designs. The pressure of compressed fluid in the fluid pockets 72 and 74 tends to axially separate the fixed and orbital scrolls 18 and 20. The force exerted on the end plate 52 of the orbital scroll 20 by compressed fluid is transferred from the end plate to the flat ring race 90, to the thrust balls 98, to the flat ring race 94 and to the front section 16 of the housing 12. The thickness of the flat ring races 90 and 94 and the diameter of the thrust balls 98 are chosen to insure that the tip seals 44 and 66 remain in sealing contact with the flat surfaces 32 and 54 on the end plates 30 and 52 and at the same time to allow axial thermal expansion of the wraps 34 and 56 during operation of the compressor 10.

The axial thrust and anti-rotation assembly 22 further includes a pair of aperture rings 100 and 102. Each of the aperture rings 100 and 102 has 16 apertures 104 with a ball chamfer 106. The number of apertures 104 in each aperture ring 100 and 102 is equal to the number of thrust balls 98 and can be increased or decreased as required to accommodate the number of thrust balls employed. The aperture ring 100 is secured to the end plate 52 of the orbital scroll 20 adjacent to the flat ring race 90. The aperture ring 102 is attached to the front section 16 of the housing 12 adjacent to the flat ring race 94. The apertures 104 and the ball chamfers 106 have diameters that allow the thrust balls 98 to travel in circular orbits relative to the flat ring races 90 and 94 and allow the orbital scroll 20 to move in a circular orbit with an orbit radius of $R_0$. The apertures 104 and the ball chamfers 106 also cooperate with the thrust balls 98 to prevent rotation of the orbital scroll 20. With most scroll designs, the apertures 104 and ball chamfers 106 cooperate with the thrust balls 98 to allow the orbital scroll 20 to orbit in a circular orbit with a radius slightly larger than $R_0$ and thereby allow compensation for variations in the geometry of the wrap flanks 36, 38, 58 and 60.

The drive assembly 24 includes a bushing assembly 108 that is rotatably journaled in the circular bore 70 in the boss 68 on the front of the orbital scroll 20 by a needle bearing 110. The bushing assembly 108 receives the splines 112 on the eccentric section 114 of a crankshaft 116. The crankshaft 116 is rotatably journaled in a double ball bearing 118. The ball bearing 118 is pressed into the tubular portion of a bearing support flange 120. The bearing support flange 120 is secured in the front section 16 of the housing 12 by countersunk flat head machine screws 122. A seal 126 seals between the forward end of the crankshaft 116 and the bore 124. The seal 126 is retained in the bore 124 by a snap ring 128. A pulley 130 is rotatably journaled on a tubular portion 132 of the front section 16 of the housing 12 by a bearing 134. The bearing 134 is retained on the tubular portion 132 by snap ring 136. The pulley 130 is retained on the bearing 134 by a snap ring 138. The pulley 130 has a central bore with splines 140 that engage splines on the forward end of the crankshaft 116 to rotate and support the crankshaft. The crankshaft 116 is axially restrained in the splines 140 by a bolt 142 that screws into a bore in the crankshaft. The pulley 130, as shown, is designed to be driven by a power band belt that engages the V-grooves 144. The pulley 130 could be modified to be driven by a standard V-belt, by a chain, by gears or some other type of torque transmission device.

Figure 2:
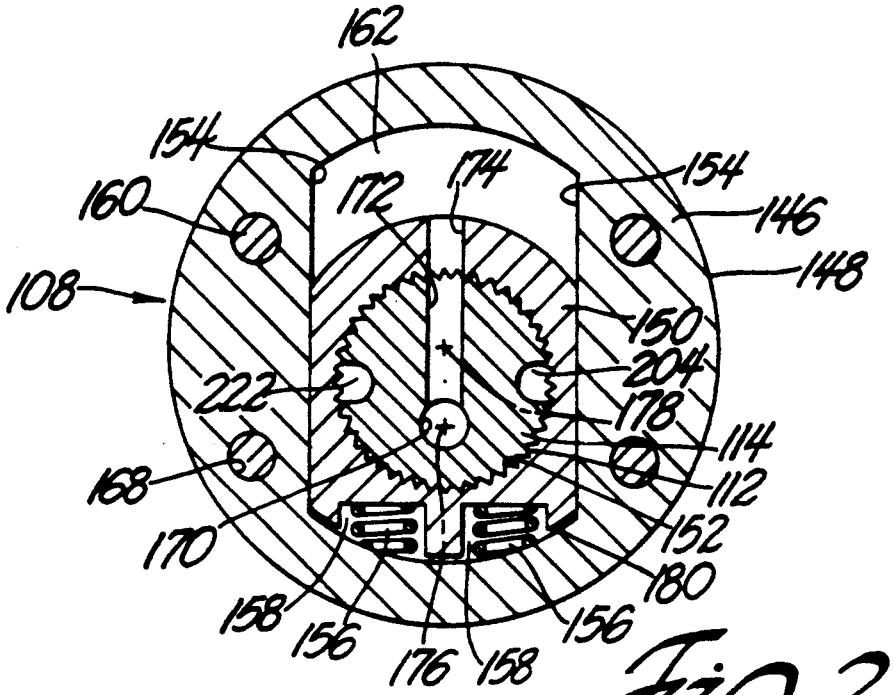
FIG. 2 is an enlarged cross section of the bushing assembly taken along line 2—2 in FIG. 1.

The bushing assembly 108, as shown in FIG. 2, includes a bushing body 146 with an outer circular surface 148 that is in direct contact with the needle bearing 110 supported in the boss 68 on the orbital scroll 20. A drive lug 150 with a splined bore 152 is mounted in a slot 154 in the bushing body 146. Four compression springs 156 are mounted in bores 158 in one side of the drive lug 150 and bias the bushing body 146 in one direction relative to the drive lug. A closed chamber 162 is formed at the end of the slot 154 opposite the four compression springs 156, by the walls of the slot 154, by the drive lug 150 by a rear plate 164 and by a front plate assembly 166. The rear plate 164 and the front plate assembly 166 are secured to the bushing body 146 by four studs 160, which are resistance welded to the rear surface of the plate assembly, that pass through the four bores 168 through the bushing body, pass through four bores through the rear plate 164 and are then cold headed. Passages 170 and 172 in the crankshaft 116 and passage 174 in the drive lug 150 connect the chamber 162 to a source of fluid under pressure. Fluid under pressure in the chamber 162 tends to compress the compression springs 156 and move the bushing body 146 relative to the drive lug 150 toward the position shown in FIG. 2.

The drive lug 150 of the bushing assembly 108 is connected to the eccentric section 114 of the crankshaft 116 by splines (112) in the splined bore 152. The drive lug 150, therefore, rotates when the crankshaft 116 rotates. The drive lug 150 is slidably positioned in the slot 154 in the bushing body 146. The drive lug 150 can not rotate in the slot 154 relative to the bushing body 146. The bushing body 146, therefore, rotates when the crankshaft 116 rotates.

The crankshaft 116 rotates about a centerline 176. The bushing body 146 has a center line at 178, as indicated in FIG. 2. When the chamber 162 is pressurized, the compression springs 156 are compressed and the bushing body 146 is in the position, shown in FIG. 2, relative to the drive lug 150, the center line 178 of the bushing body 146 is spaced from the center line 176 of the crankshaft 116 a distance substantially equal to the orbit radius $R_0$ of the orbital scroll 20. In this position, the flanks 36, 38, 58 and 60 of the wraps 34 and 56 on the fixed scroll 18 and the orbital scroll 20 are in contact and sealed fluid pockets 72 and 74 are formed. Rotation of the crankshaft 116 will drive the orbital scroll 20 in a circular orbit with a radius $R_0$ and fluid will be compressed.

There may be slight variations in the geometry of the flanks 36, 38, 58 and 60 of the wraps 34 and 56. The pressure of compressed fluid in the chamber 162 forces the flanks of the wraps 34 and 56 into sealing contact. The compressed fluid in the chamber will allow movement of the bushing body 146 relative to the drive lug 150, thereby changing the radius of the actual orbit of the orbital scroll 20 to accommodate variations in scroll geometry. A slight space 180 is normally present between the bushing body 146 and the drive lug 150 when the orbital scroll 20 is being driven so that the bushing body can move in either direction relative to the drive lug 150 to accommodate all variations in the geometry of the surfaces of the flanks 36, 38, 58 and 60 of the scrolls 18 and 20.

Release of the compressed fluid in the chamber 162 will allow the compression springs 156 to expand and move the bushing body from the position shown in FIG. 2. As the compression springs 156 expand, the center line 178 of the bushing body 146 moves toward the center line 176 of the crankshaft 116. When the bushing body 146 moves to a point in which the chamber 162 disappears and the drive lug 150 is in the opposite end of the slot 154 from the position shown in FIG. 2, the center line 178 of the bushing body 146 will coincide with the centerline 176 of the crankshaft 116, the radius at which the crankshaft drives the orbital scroll 20 will become zero and the orbital scroll 20 will stop moving. The bushing body 146 will merely rotate in the needle bearing 110 and there will be very little or no orbital movement of the orbital scroll 20.

The orbital scroll 20 must be dynamically balanced to prevent vibration when the orbital scroll is being driven in a generally circular orbit with a radius $R_0$. When the orbital scroll 20 stops moving in an orbital path because the effective throw of the crankshaft 116 and the bushing assembly 108 becomes zero, the crankshaft 116 can continue to rotate and the balance system 26 must be balanced.

The balance system 26 includes a cylindrical extension 182 which is integral with and extends forward from the plate assembly 166. A front weight assembly 184 and a rear weight assembly 186 are supported on the cylindrical extension 182. The front weight assembly 184 has a ring 188 journaled on the cylindrical extension 182. A secondary support arm 190 is secured to the ring 188, extends radially outward and has a free end that extends forwardly and generally parallel to the centerline 176. A secondary balance weight 192 is secured to the free end of the secondary support arm 190. A primary support arm 194 is secured to the ring 188, extends radially outward in the opposite direction from the secondary support arm 190 and has a free end that extends rearwardly and generally parallel to the centerline 176. A primary balance weight 196 is secured to the free end of the primary support arm 194. A control arm 198 is integral with the ring 188 and extends radially inward through a slot 200 in the cylindrical extension 182. A bar 202 with bearing surfaces is attached to the inner end of the control arm 198 by welding. The bar 202 is positioned in a slot 204 machined into the eccentric section 114 of the crankshaft 116. The slot 204 has a long axis that is parallel to the centerline 176 the crankshaft 116 rotates about. The slot 204 extends to the rear end of the eccentric section 114 of the crankshaft 116, parallel to the centerline 176 and through a portion of the splines 112 to accommodate assembly. The bar 202 can pivot in the slot 204 about an axis that is parallel to the centerline 176 and can also move radially in the slot.

The rear weight assembly 186 has a ring 206 journaled on the cylindrical extension 182. A secondary support arm 208 is secured to the ring 206 extends radially outward and has a free end that extends forwardly and generally parallel to the centerline 176. A secondary balance weight 210 is secured to the free end of the secondary support arm 208. A primary support arm 212 is secured to the ring 206, extends radially outward in the opposite direction from the secondary support arm 208 and has a free end that extends rearwardly and generally parallel to the centerline 176. A primary balance weight 214 is secured to the free end of the primary support arm 212. A control arm 216 is integral with the ring 206 and extends radially inward through a slot 218 in the cylindrical extension 182. A bar 220 with bearing surfaces is attached to the inner end of the control arm 216 by welding. The bar 220 is positioned in a slot 222 machined into the eccentric section 114 of the crankshaft 116. The slot 222 has a long axis that is parallel to the centerline 176 the crankshaft 116 rotates about and to the long axis of the slot 204. The slot 222 extends to the rear end of the eccentric section 114 of the crankshaft 116 and through a portion of the splines 112 to accommodate assembly. The bar 220 can pivot in the slot 222 about an axis that is parallel to the center line 176 and can also move radially in the slot.

The front weight assembly 184 and the rear weight assembly 186 are retained on the cylindrical extension 182 by a weight assembly retainer ring 224 that is secured to the cylindrical extension 182 by four studs 225. The four studs 225 are resistance welded to the rear surface of the retainer ring 224. Each of the studs 225 pass through slots 226 in the ring portion 188 of the front weight assembly 184 and pass through slots 227 in the ring portion 206 of the rear weight assembly 186, pass through bores through the front plate assembly 166 and are then cold headed.

Figure 7:
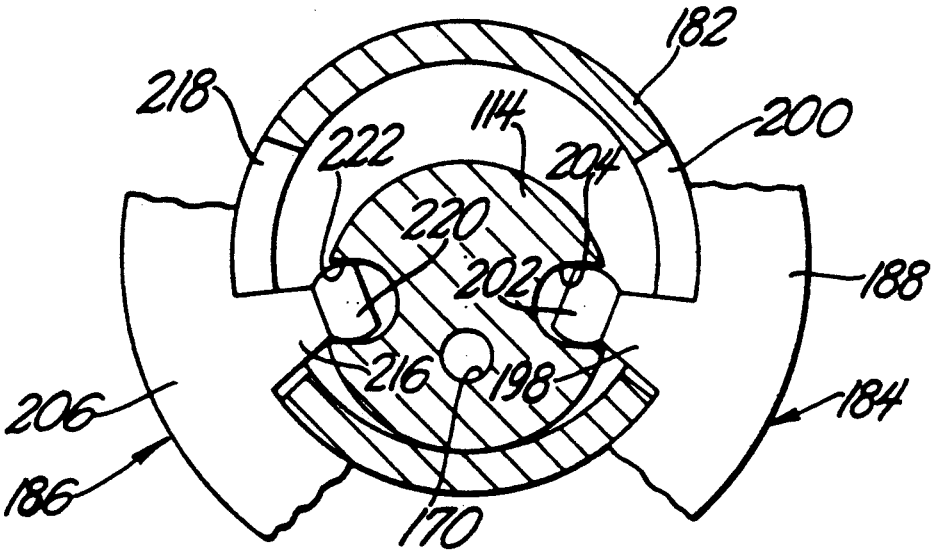
FIG. 7 is an enlarged cross sectional view of the balance weight shift assembly taken along line 4—4 in FIG. 1 with the balance weights in the position for balancing orbital movement of the orbital scroll and with portions of the balance weights broken away.

The release of compressed fluid from the chamber 162 in the bushing assembly 108 allows the compression springs 156 to slide the bushing body 146 relative to drive lug 150. Because the cylindrical extension 182 is integral with the plate assembly 166 and the plate assembly 166 is secured to the bushing body 146, movement of the bushing body 146 relative to the drive lug 150 moves the cylindrical extension 182 downwardly relative to the eccentric section 114 of the crankshaft 116 from the position shown in FIGS. 2 and 7. As a result of this relative movement between the eccentric section 114 of the crankshaft 116 and the cylindrical extension 182 from the position shown in FIGS. 2 and 7, the front weight assembly 184 rotates counter-clockwise about the cylindrical extension 182 and the rear weight assembly 186 rotates clockwise about the cylindrical extension. Counter-clockwise rotation of the front weight assembly 184 and clockwise rotation of the rear weight assembly 186 on the cylindrical extension 182 from the position seen in FIG. 3 moves the primary balance weight 196 away from the primary balance weight 214 and moves the secondary balance weight 192 away from the secondary balance weight 210 to the position shown in FIG. 5. The secondary support arm 190 and the primary support arm 212 each extend through arcs of about 90 degrees about the center of the cylindrical extension 182. The primary support arm 194 and the secondary support arm 208 only extend through arcs of about 45 degrees about the center of the cylindrical extension 182. The reduced arc lengths of the primary support arm 194 and the secondary support arm 208 allows the primary balance wight 196 to move to a position behind the secondary support arm 208 and the secondary balance weight 210 to move to a position in front of the primary support arm 194 in response to counter-clockwise rotation of the front weight assembly 184 relative to the rear weight assembly 186. Directing compressed fluid back into the chamber 162 and compressing the compression springs 156 will rotate the front weight assembly 184 clockwise about the cylindrical extension 182 and the rear weight assembly 186 counter-clockwise about the cylindrical extension until the weight assemblies return to the position shown in FIG. 3.

Figure 3:
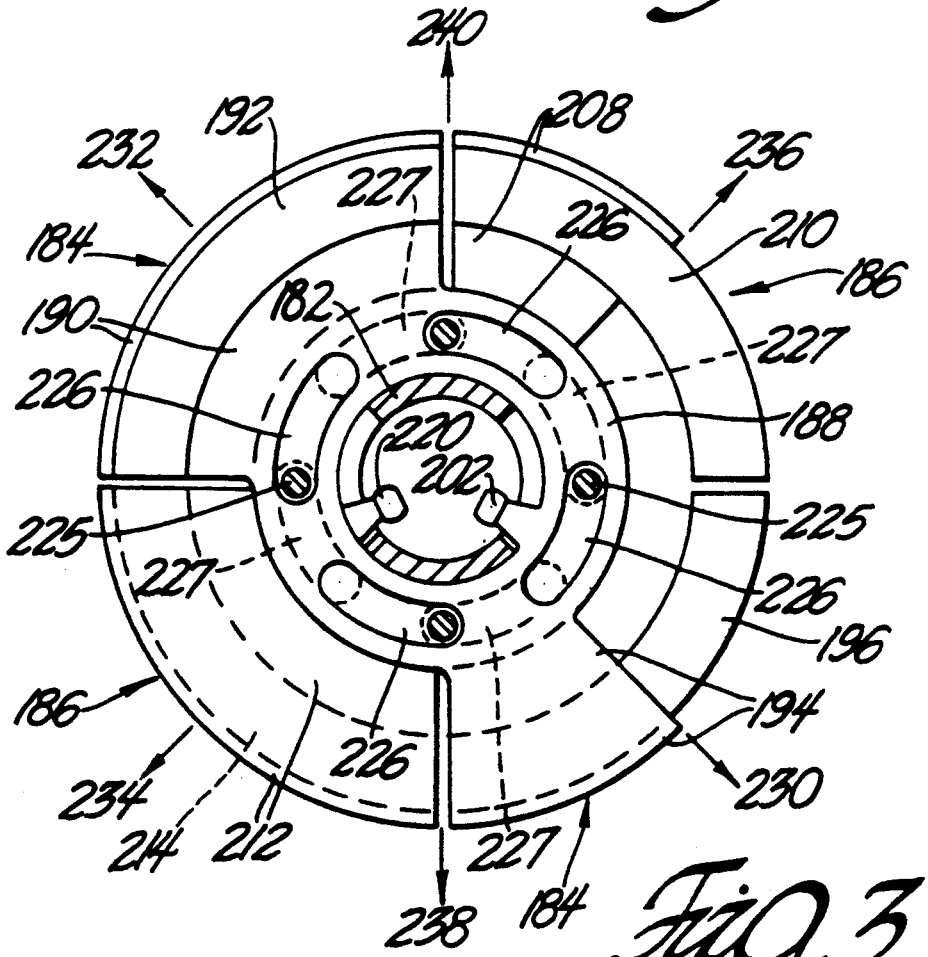
FIG. 3 is a cross sectional view of the balance weights in the position for balancing orbital movement of the orbital scroll, taken along line 3—3 in FIG. 1.
Figure 4:
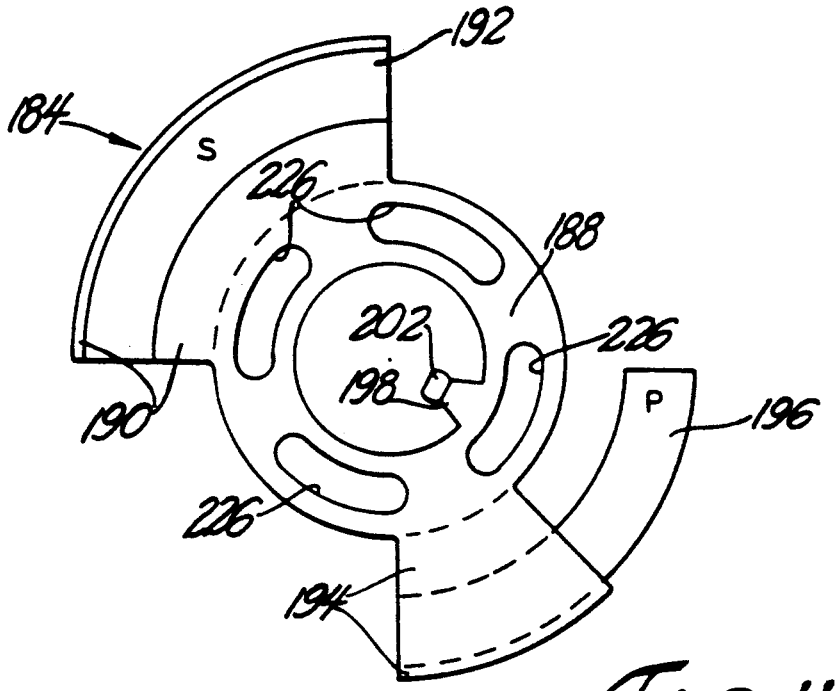
FIG. 4 is a view of the front weight assembly only as seen in FIG. 3.

The front and rear weight assemblies 184 and 186 are shown in FIG. 3 in the proper position for balancing the orbital scroll 20 when the scroll compressor 10 is compressing fluid. The primary weight 196 of front weight assembly 184 exerts a force $F_{p1}$ in the direction indicated by arrow 230 in FIG. 3. The secondary weight 192 of the front weight assembly 184 exerts a force $F_{21}$ in the direction indicated by arrow 232. The primary weight 214 of the rear weight assembly 186 exerts a force $F_{p2}$ in the direction indicated by arrow 234. The secondary weight 210 of the rear weight assembly 186 exerts a force $F_{s2}$ in the direction indicated by arrow 236. The combined force $F_{cp}$ exerted by the primary weights 196 and 214 of the front and rear weight assemblies 184 and 186 is:

$$F_{cp}=(F_{p1}\cdot\text{Cosine } 45°)+(F_{p2}\cdot\text{Cosine } 45°)$$

The direction in which the combined force $F_{cp}$ exerted by the primary weights acts is indicated by arrow 238. The combined force $F_{cs}$ exerted by the secondary weights 192 and 210 of the front and rear weight assemblies 184 and 186 is:

$$F_{cs}=(F_{s1}\cdot\text{Cosine } 45°)+(F_{s2}\cdot\text{Cosine } 45°)$$

The direction in which the combined force $F_{cs}$ exerted by the secondary weights acts is indicated by arrow 240. The arrow 240 and the arrow 238 are in a plane through the center line 178 of the cylindrical extension 182 and in opposite directions from each other. The combined force $F_{cp}$ exerted by the primary weights 196 and 214 is larger than the combined force $F_{cs}$ exerted by the secondary weights 192 and 210. The difference between the two combined forces $F_{cp}-F_{cs}$ is the force required to balance the orbital scroll 20. The two forces $F_{cp}$ and $F_{cs}$ also satisfy the requirement of balancing the moment which results from the fact that the center of gravity of the orbital scroll 20 and the primary balance weights 196 and 214 are located in different transverse planes.

Releasing compressed fluid from the chamber 162 in the bushing assembly 108 allows the compression springs 156 to expand and move the bushing body 146 relative to the drive lug 150 until the drive lug contacts the end wall of the slot 154 and is opposite the position shown in FIG. 2. This movement of the bushing body 146 relative to the drive lug 150 will rotate the front weight assembly 184 45° in one direction and the rear weight assembly 186 45° in the other direction about the axis of cylindrical extension 182 to the positions shown in FIG. 5.

Figure 5:
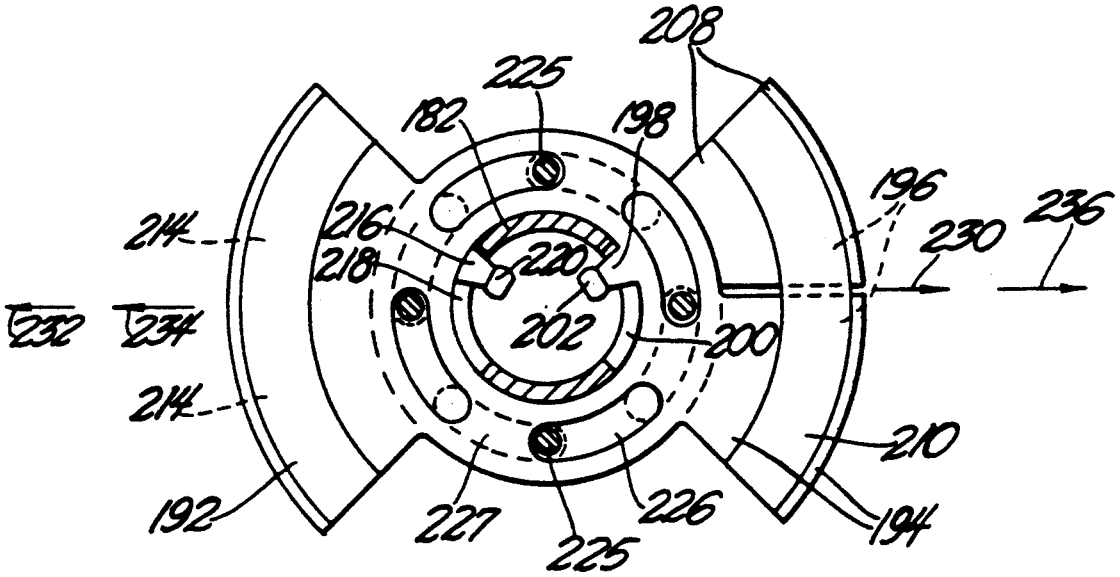
FIG. 5 is a view of the balance weights similar to FIG. 3 with the front and rear balance weights in the position for balancing each other when the orbital scroll is stationary.

In the position shown in FIG. 5, the primary weight 196 of the front weight assembly 184 is positioned 180° from the primary weight 214 of the rear weight assembly 186. The force $F_{p1}$ indicated by the arrow 230 is therefore in a direction directly opposite the force $F_{p2}$ indicated by the arrow 234. Because the primary weight 196 is the same size as the primary weight 214, $F_{p1}$ is equal to $F_{p2}$ and the primary weights 196 and 214 balance each other. The secondary weight 192 of the front weight assembly 184 is positioned 180° from the secondary weight 210 of the rear weight assembly 186. The force $F_{s1}$ indicated by the arrow 232 is therefore in a direction opposite the force $F_{s2}$ indicated by the arrow 236. Because the secondary weight 192 is the same size as the secondary weight 210, $F_{s1}$ is equal to $F_{s2}$ and the secondary weights 192 and 210 balance each other. It should also be noted that the distance of the center of gravity of the primary weight 196 from the axis of the assembly 108 represented by centerline 178 is the same as the distance of the center of gravity of the primary weight 214 from the axis of the bushing assembly 108 and that the distance of the center of gravity of the secondary weight 192 from the axis of the bushing assembly 108 is the same as the distance of the center of gravity of the secondary weight 210 from the axis of the bushing assembly 108.

The inertial forces of the primary weights 196 and 214 are not equal to the inertial forces of the secondary weights 192 and 210. The inertial forces of the primary weights 196 and 214 and the secondary weights 192 and 210 are determined by the dual requirements of mutually satisfying both radial balance and moment balance.

Figure 6:
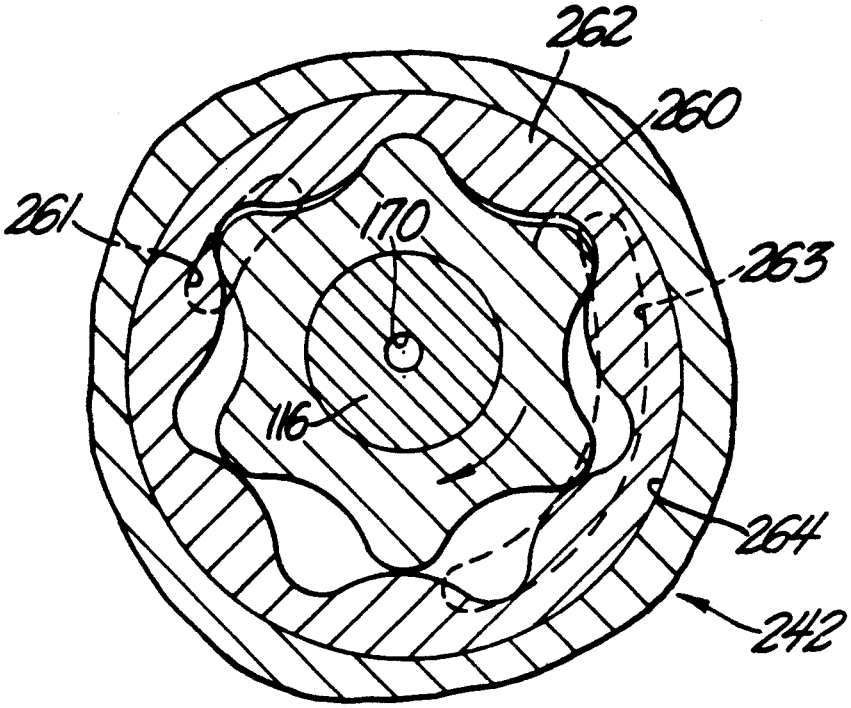
FIG. 6 is an enlarged cross sectional view of the small trigger compressor taken along 6—6 in FIG. 1.
Figure 9:
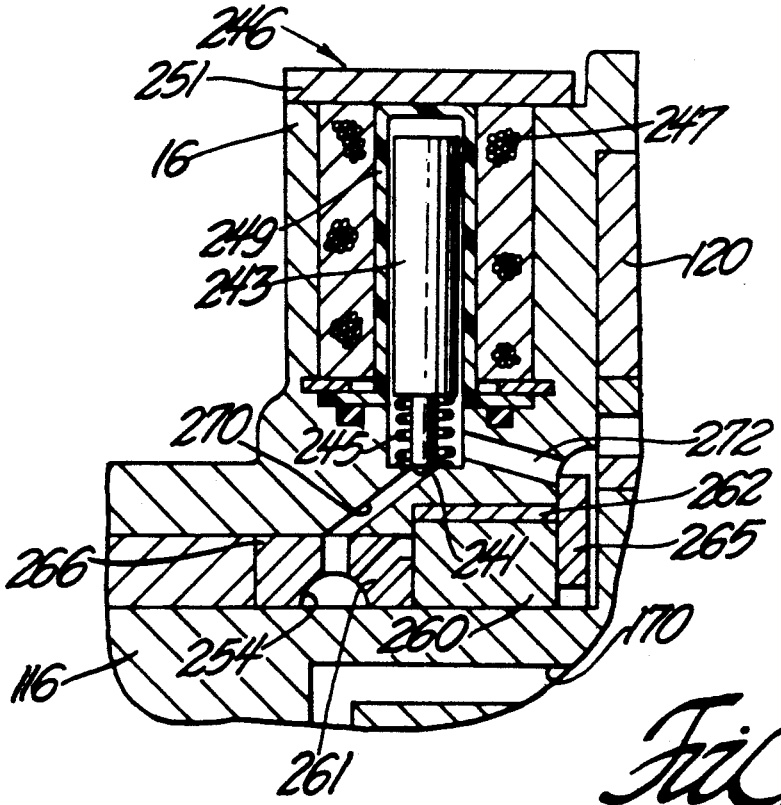
FIG. 9 is an enlarged cross sectional view of a portion of the front housing and one possible connection of a solenoid valve to the housing.

The control system 28 for engaging and disengaging the drive for the orbital scroll 20 is shown schematically in FIG. 10. The control system 28 includes a small trigger compressor 242, a relief valve 244, a solenoid valve 246 and an actuator 248. The small trigger compressor 242 takes in fluid from the sump 88, compresses the fluid and forces the fluid into a supply gallery 254. The relief valve 244 allows compressed fluid in the gallery 254 to pass to the sump (88) if the pressure of fluid in the gallery exceeds a predetermined amount. A solenoid valve 246 is normally open and passes fluid in the gallery 254 to the sump 88 without appreciably increasing its pressure. When the solenoid valve is closed, the pressure of fluid in the gallery 254 increases and compressed fluid is forced into the actuator 248. The small trigger compressor 242 is a "Geroter" gear type pump as shown in FIG. 6 with an external toothed gear 260 and an internal toothed gear 262. The external toothed gear 260 is secured directly to and is driven by the crankshaft 116. The internal toothed gear 262 is rotatably journaled in a bore 264 in the front section 16 of the housing for rotation about an axis that is offset from the axis of rotation of the crankshaft 116. The small trigger compressor 242 draws in fluid from the sump 88. The fluid that is drawn in passes through the double ball bearing 118 and through the suction port 263 in the fixed port plate 265. Compressed fluid exits the front side of the small trigger compressor 242 through a discharge port 261 in the fixed block 266 in the bore 124 and flows into the supply gallery 254. The location of the discharge port 261 relative to external tooth gear 260 and the internal toothed gear 262 is shown in FIG. 6. The supply gallery 254 delivers compressed fluid to passages 170 and 172 in the crankshaft 116 when the solenoid valve 246 is closed. When the solenoid valve 246 is open it directs fluid back into the sump 88. The relief valve 244 allows compressed fluid to pass directly from the gallery 254 to the sump 88 when pressure in the gallery 254 exceeds a predetermined value. The relief valve 244 is mounted inside passages in the front section 16 of the housing 12. The solenoid valve 246 is connected to bores 270 and 272 in the front section 16 of the housing 12 that are connected to the gallery 254 and to the sump 88, as shown in FIG. 9. The solenoid valve 246 includes a valve seat 241, a plunger 243, a compression spring 245 which lifts the plunger off the valve seat to open the solenoid valve, a solenoid coil 247 which, when energized, forces the plunger down onto the valve seat thereby closing the solenoid valve and compressing the compression spring. A hermetic sleeve 249 is provided to isolate the solenoid coil 247 from the fluid inside the compressor 10. A Cap 251 closes the bore, in the front section of the housing 16, in which the compression spring 245, the plunger 243 and the solenoid coil 247 are mounted. The relief valve 244 can be built into the solenoid valve 246, if desired.

The relief valve 244 could be eliminated from the control system 28 by providing sufficient leakage to protect the small trigger compressor 242 from excessive control system pressure. The leakage could be in the small trigger compressor 242, the solenoid valve 246, the actuator 248 or from the passages that carry fluid to the small trigger compressor.

Operation of the compressor 10 normally begins with the pulley 130 driving the crankshaft 116, with the solenoid valve 246 open, with the orbital scroll 20 stationary and with the front weight assembly 184 and the rear weight assembly 186 in the position shown in FIG. 5. With the front and rear weight assemblies 184 and 186 in the position shown in FIG. 5 they balance each other and rotate about the center line 176 with the crankshaft 116. To compress fluid with the compressor 10, the solenoid valve 246 is closed to block the flow of compressed fluid from the small trigger compressor 242 to the gallery 254 through the bore 270 and the bore 272 and to the sump 88. Blocking the flow of fluid from the small trigger compressor 242 through the gallery 245, through the bores 270 and 272 and to the sump 88 results in the fluid pressure in the gallery 254 increasing and fluid being forced through the passages 170 and 172 in the crankshaft 116 and into the chamber 162 in the actuator 248 in the bushing assembly 108. As the fluid pressure in the chamber 162 increases, it moves the bushing body 146 relative to the drive lug 150 toward the position shown in FIG. 2 and compresses the compression springs 156. As the bushing body 146 moves relative to the drive lug 150 toward the position shown in FIG. 2, the cylindrical extension 182 which is connected to the bushing body 146 moves to the position shown in FIGS. 3 and 7, the front weight assembly 184 rotates clockwise about the axis of the cylindrical extension and the rear weight assembly 186 rotates counterclockwise about the axis of the cylindrical extension to the positions shown in FIGS. 3 and 7. In this position the front weight assembly 184 and the rear weight assembly 186 balance orbital movement of the orbital scroll 10 and rotate about the centerline 178 of the bushing assembly 108.

Movement of the bushing body 146 relative to the drive lug 150 toward the position shown in FIG. 2 also moves the flanks 36 and 38 of the wrap 34 into contact with the flanks 58 and 60 of the wrap 56 to form sealed pockets 72 and 74. Movement of the bushing body 146 relatively to the drive lug 150 to slightly compress the compression springs 156 will create a crankshaft throw and will result in the orbital scroll 20 being driven in an orbital path. The fixed scroll 18 and the orbital scroll 20 will not compress fluid until the flanks 36 and 38 are in contact with the flanks 58 and 60 and the effective throw of the crankshaft 116 and the bushing assembly 108 is substantially the same as the orbit radius $R_0$ of the orbital scroll 20. As soon as the scrolls 18 and 20 form sealed fluid pockets, the compressor will start compressing fluid.

To stop compressing fluid, the solenoid valve 246 is opened to allow fluid from the small trigger compressor 242, and compressed fluid in the chamber 162 in the bushing assembly 108 to flow to the gallery 254 and through the bores 270 and 272 to the sump 88. The reduction of fluid pressure in the chamber 162 will allow the compression springs 156 to expand and start moving the bushing body 146 relative to the drive lug 150 and reducing the volume of the chamber. As soon as the wrap 56 of the scroll 20 has moved away from the wrap 34 of the fixed scroll 18 sufficiently to discontinue the seals along the lines at 76, 78, 80 and 82, the fixed scroll and the orbital scroll will stop compressing fluid. The compression springs 156 will, however, continue to expand until the drive lug 150 contacts the end of the slot 154 in the bushing body 146 opposite the compression springs and the volume of the chamber 162 is reduced to its smallest size. When the compression springs 156 are expanded to their maximum extent, the effective throw of the crankshaft 116 and the bushing assembly 108 will be zero. The orbital scroll (20) will stop orbiting when the throw is zero and the front weight assembly 184 and the rear weight assembly 186 will be in the position shown in FIG. 5. In this position the two weight assemblies 184 and 186 balance each other.

The preferred embodiment of the invention has been described in detail but is an example only and the invention is not restricted thereto. It will be easily understood by those skilled in the art that modifications and variations can easily be made within the scope of this invention.

What is claimed is:

1. A scroll type fluid material handling machine having a housing with a fluid inlet and a fluid outlet; a stationary scroll with an end plate and a wrap mounted in the housing; an orbital scroll with an end plate and a wrap mounted in the housing; a drive assembly for driving the orbital scroll in a generally circular orbit including a crankshaft rotatably mounted in the housing for rotation about an axis, a drive member connected to the crankshaft outside the housing, an eccentric section on the crankshaft, a bushing assembly including a drive lug secured to the eccentric section of the crankshaft, a bushing body with a slot that encompasses the drive lug and with a surface that is journaled on the orbital scroll for pivotal movement about a bushing body axis and wherein the bushing body is movable relative to the drive lug from a position in which the axis of rotation of the crankshaft coincides with the bushing body axis to a position in which the wrap of the orbital scroll is in sealing contact with the wrap of the stationary scroll; and a balance assembly for balancing orbital motion of the orbital scroll.

2. A scroll type fluid compressor having a housing with a fluid inlet and a fluid outlet; a stationary scroll with an end plate and a wrap mounted in the housing; an orbital scroll with an end plate and a wrap mounted in the housing; a drive assembly for driving the orbital scroll in a generally circular orbit including a crankshaft rotatably mounted in the housing for rotation about a crankshaft axis, a drive member connected to the crankshaft outside the housing, an eccentric section on the crankshaft, a bushing assembly including a drive lug secured to the eccentric section of the crankshaft by splines and a bushing body with a slot that encompasses the drive lug and forms an enclosed chamber at one end of the drive lug, a surface on the bushing body that is rotatably journaled in a bore on the orbital scroll to permit rotation of the bushing body relative to the orbital scroll about a bushing body axis and wherein the bushing assembly is movable relative to the drive lug from a position in which the axis of rotation, of the crankshaft coincides with the bushing body axis to a position in which the wrap of the orbital scroll is in sealing contact with the wrap of the stationary scroll; a balance assembly for balancing orbital motion of the orbital scroll; and a control system, for shifting the bushing body relative to the drive lug between the positions in which the axis of the crankshaft coincide with the bushing body axis and the orbital scroll is not moved in an orbital path and a position in which the wrap of the orbital scroll is in sealing contact with the wrap of the stationary scroll and the orbital scroll is driven in a generally circular orbit, by forcing compressed fluid into or letting compressed fluid out of the enclosed chamber formed by the slot in the bushing body and the drive lug.

* * * * *